US009321295B2

(12) United States Patent
Santos

(10) Patent No.: US 9,321,295 B2
(45) Date of Patent: Apr. 26, 2016

(54) PAPER CLIP BEARING A PLATE

(76) Inventor: Arsenio P. Santos, Aloha, OR (US)

( * ) Notice: Subject to any disclaimer, the term of this patent is extended or adjusted under 35 U.S.C. 154(b) by 44 days.

(21) Appl. No.: 13/806,882

(22) PCT Filed: Jun. 27, 2011

(86) PCT No.: PCT/US2011/042059

§ 371 (c)(1),
(2), (4) Date: Dec. 26, 2012

(87) PCT Pub. No.: WO2012/006037

PCT Pub. Date: Jan. 12, 2012

(65) Prior Publication Data

US 2013/0205565 A1 Aug. 15, 2013

Related U.S. Application Data

(60) Provisional application No. 61/359,537, filed on Jun. 29, 2010.

(51) Int. Cl.

| | |
|---|---|
| ***B42F 1/02*** | (2006.01) |
| ***F21V 33/00*** | (2006.01) |
| ***B42F 1/08*** | (2006.01) |

(52) U.S. Cl.

CPC ... *B42F 1/02* (2013.01); *B42F 1/08* (2013.01); *F21V 33/0048* (2013.01); *B42P 2221/06* (2013.01); *Y10T 24/202* (2015.01); *Y10T 29/49826* (2015.01); *Y10T 29/49863* (2015.01); *Y10T 29/49867* (2015.01); *Y10T 29/49869* (2015.01); *Y10T 29/49876* (2015.01)

(58) Field of Classification Search

CPC ..... B42F 1/02; B42F 1/08; F21V 33/0048; Y10T 29/49869; Y10T 29/49876; Y10T 29/49867; Y10T 29/49863; Y10T 24/202; Y10T 29/49826; B42P 2221/06

USPC ..... 29/425.08, 446, 448, 449, 453, 13, 428; 24/67.9, 67.3; 362/382

See application file for complete search history.

(56) References Cited

U.S. PATENT DOCUMENTS

| | | | | | |
|---|---|---|---|---|---|
| 761,635 | A * | 5/1904 | Kelley | B42F 1/08 | 24/547 |
| 3,123,924 | A * | 3/1964 | Roberts | 40/659 | |
| 4,308,797 | A * | 1/1982 | Becker et al. | 101/292 | |
| 4,458,386 | A * | 7/1984 | Fernandez | B42F 1/02 | 24/545 |
| 4,761,862 | A * | 8/1988 | Hiromori | 24/67.9 | |
| 2009/0279718 | A1 * | 11/2009 | Caploon | 381/124 | |

* cited by examiner

*Primary Examiner* — John C Hong

(74) *Attorney, Agent, or Firm* — Steinberg Intellectual Property Law LLC; Gloria M. Steinberg, Esq.

(57) ABSTRACT

A paper clip assembly, that includes a wire frame that is formed into a loop and a jaw that protrudes outwardly from the loop. Also, a plate insert is shaped to fit into said loop, and in one embodiment is fit into the loop, to form a paper clip having a plate that can bear a message.

18 Claims, 7 Drawing Sheets

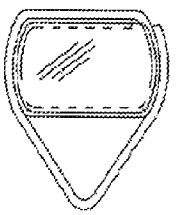
FIG. 5A
FIG. 5B
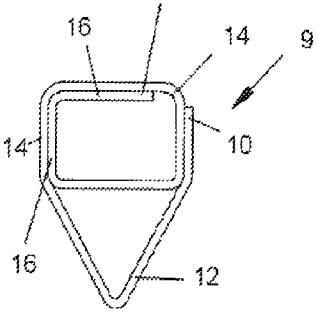
FIG. 6A
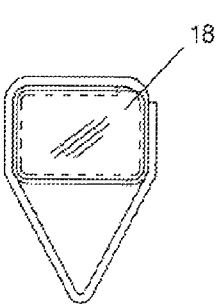
FIG. 6B
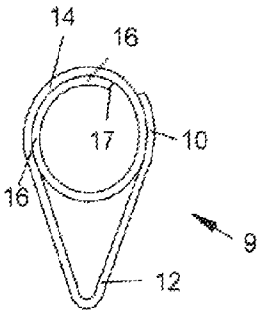
FIG. 7A
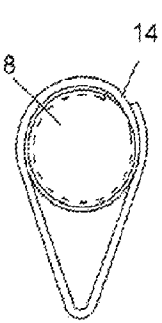
FIG. 7B
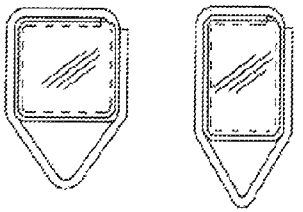
FIG. 8
FIG. 9
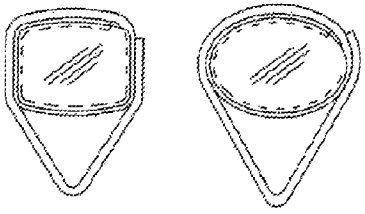
FIG. 10
FIG. 11

PAPER CLIP BEARING A PLATE

BACKGROUND

Those wishing to promote a business currently may choose from a great number of items that can be personalized with some message. For example coffee cups, t-shirts, pens and jackets are frequently used as promotional items. Indeed, the wide range of items used for promotion amply shows that if there is a way to make an item into a promotional item, there will be a market for that promotional item. Yet there is little in the way of promotional paper clips. A large plastic molded clip that has an area in the center for carrying a message, is available. This does not appear to be very good at holding papers together, however, and would appear to only be practical for fairly long production runs, as the printing process appears to be part of the original manufacturing process. There are larger, all purpose clips that are used for promotional items, but there appears to be little deserving the title "paper clip" that is used for promotional purposes.

In another consideration, anyone who has worked in an office knows that there are times when some set of papers has a particular importance. An assistant may not wish to place this set of papers on his bosses' desk, as it may blend in with other papers on the desk. If the papers are put on the chair seat there is some chance they will be sat on, or get buried under later papers placed in the same spot. Accordingly, there should be some way to mark papers in such a way that they are certain to attract attention.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a paper clip assembly that includes a wire frame that is formed into a loop and a jaw that protrudes outwardly from the loop. Also, a plate insert is shaped to fit into the loop, and in one embodiment is fit into the loop, to form a paper clip having a plate that can bear a message.

In a second separate aspect, the present invention may take the form of a method of drawing attention to a set of papers, which utilizes a paper clip having an activatable signal light assembly. The method includes clipping the paper clip to the set of papers and activating the signal light assembly, whereby the set of papers has a blinking light attached to it, attracting attention to it.

In a third separate aspect, the present invention may take the form of a method of providing paper clips bearing a message, which utilizes: A set of substantially identical wire frames, defining an opening; a set of inserts, each sized and shaped to be retained in the opening; and a set of adhesive labels, sized and shaped to be adhered to the inserts. The method includes printing a message on each of the labels, adhering each of the labels to an insert; and placing each insert into an opening.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

FIG. 5A is a front view of a wire frame, used in an alternative embodiment of a paper clip, according to the present invention.

FIG. 5B is an alternative embodiment of a paper clip according to the present invention, using the wire frame of FIG. 5A FIG. 6A is a front view of a wire frame, used in an additional alternative embodiment of a paper clip, according to the present invention.

FIG. 6B is an additional alternative embodiment of a paper clip according to the present invention, using the wire frame of FIG. 6A.

FIG. 7A is a front view of a wire frame, used in an additional alternative embodiment of a paper clip, according to the present invention.

FIG. 7B is an additional alternative embodiment of a paper clip according to the present invention, using the wire frame of FIG. 7A.

FIG. 8, shows an additional alternative embodiment of a paper clip according to the present invention.

FIG. 9, shows an additional alternative embodiment of a paper clip according to the present invention.

FIG. 10, shows an additional alternative embodiment of a paper clip according to the present invention.

FIG. 11, shows an additional alternative embodiment of a paper clip according to the present invention.

DETAILED DESCRIPTION OF THE PREFERRED EMBODIMENTS

Figure 3A:
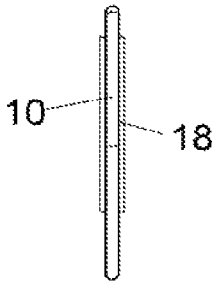
FIG. 3A is an elevation side view of the clip of FIG. 2.
Figure 3B:
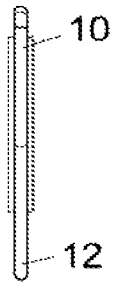
FIG. 3B is an elevation side view, showing the side opposite to that shown in FIG. 3A, of the clip of FIG. 2.
Figure 1:
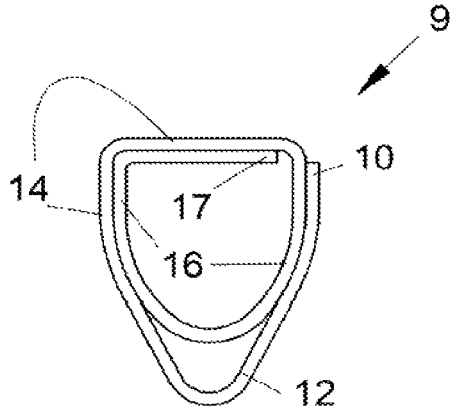
FIG. 1 is a front view of a paper clip wire frame, for a paper clip according to the present invention.
Figure 4A:
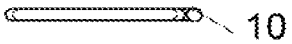
FIG. 4A is a horizontal side view of the wire frame of FIG. 1
Figure 4B:
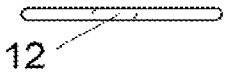
FIG. 4B is a horizontal side view, showing the side opposite to that shown in FIG. 4A, of the wire frame of FIG. 1.
Figure 2:
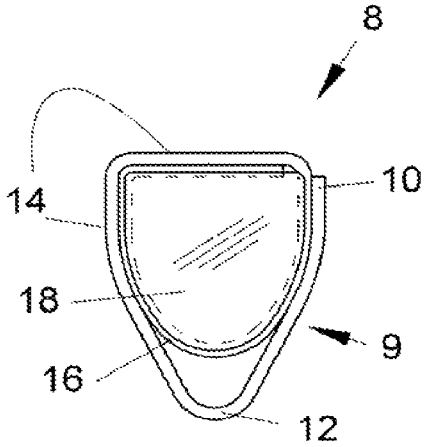
FIG. 2 is a front view of a paper clip according to the present invention, incorporating the frame of FIG. 1.

Referring to FIGS. 1 and 2, a preferred embodiment of the present invention may take the form of a paper clip 8 (FIG. 2)

having a wire frame 9 (FIG. 1), that begins with an outer terminus 10, proceeds through a jaw 12, and then through a bridge section 14, leading to an inner loop 16, ending in inner terminus 17, and which supports a solid plate insert 18. Plate 18 is supported by a gutter 20 (FIGS. 12 & 13) defined circumferentially around the in the edge of plate 18, which engages with inner loop 16.

In one preferred embodiment plate 18 hosts a sound chip that has a recording on it and a battery, directed to causing a positive reaction in a paperclip user. In a humorous adaptation, the plate is adapted to sense pressure, and to respond by saying, "ouch, that hurts." In another the plate detects motion, and responds by saying "Merry Christmas" or "where are you taking me?" In an alternative preferred embodiment, a microphone is included, and the sound chip may accept a sound recording, thereby making it possible for a person leaving a set of papers for another, to leave instructions on the paper clip.

In another preferred embodiment, plate 18 is printed with some promotional message, such as "Dave's Auto Repair" or "Greenblatt & Al Mansour, conflict resolving workshops." In one preferred embodiment, plate 18 is magnetic. So that clip 8 may be attached to a file cabinet, either with or without a paper clipped. In a preferred embodiment, plate 18 is provided to a user with no message printed upon it and the user is provided with properly sized and shaped adhesive labels, so that he may print his own message, and adhere it to plate 18.

Plate 18 may be removed by pressing on it to move the portion of inner loop 16 that is adjacent to the outer terminus 10 out of alignment with the plane of the paper clip 8, and then pushing a thin object, such as a finger nail or thin plate tool, between plate 18 and that part of wire frame 9. Plate 18 may be replaced into wire frame 9 through a reverse motion.

In one preferred embodiment, plate 18 is provided separately from wire frame 9, and the user puts them together after printing a message onto plate 18 or otherwise marking it. In one embodiment, a set of clips 8, are sold together with printer control software and blank labels shaped to fit onto plates 9, thereby permitting a user to easily produce a sizable set of clips bearing a desired message.

Figure 12:
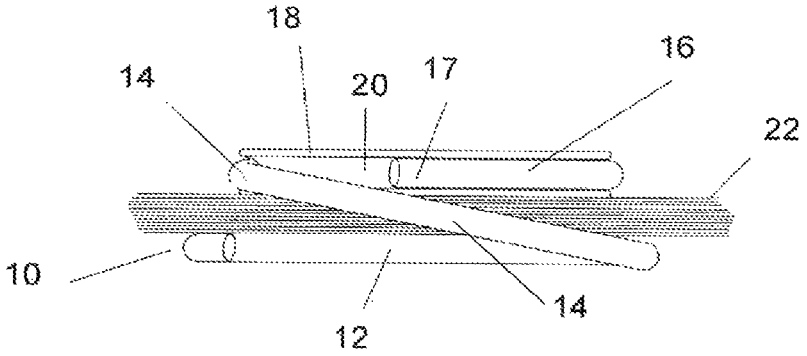
FIG. 12 shows a clip according to the present invention in use, holding papers together.

Referring now to FIGS. 5A through 11, wire frame 9 may be formed with differing interior areas to support differently shaped plates 18. Referring to FIG. 12, the clip holds a set of papers 22 by interposing papers 22 between jaw 12 and inner loop 16. A user may press downwardly against (or upwardly) against plate 18, with his thumb, while holding jaw 12 with his fingers, slide papers 22 into the gap thereby created, and release. In an alternative preferred method papers 22 are engaged with jaw 12 and used to resist the downward or upward pressure of a user's thumb pressing on plate 18. As the user presses against plate 18, moving it out of the plane of clip 8, plate 18 may become partially disengaged with wire frame 9 in the area that is adjacent to the inner terminus 17 of frame 9, and that also abuts outer terminus 10.

Figure 13:
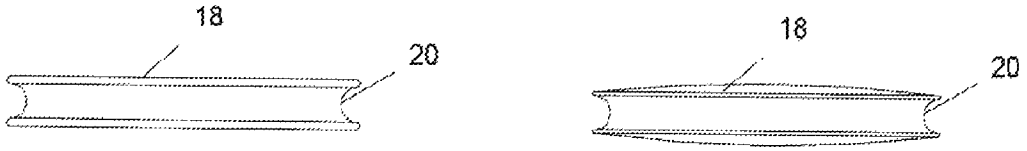
FIG. 13 shows two side views of inserts, adapted to be used in two alternative embodiments of paper clips according to the present invention.
Figure 14:
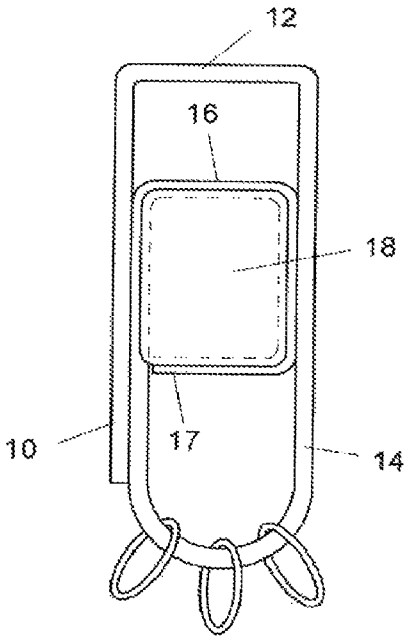
FIG. 14 shows a paper clip/key ring according to the present invention.

Referring to FIG. 13, plate 18 may be flat or slightly domed on the top and bottom, to provide a more luxurious feel. As shown in FIG. 14, in addition to use clipping papers, clip 8 may also used as a key ring.

Figure 15A:
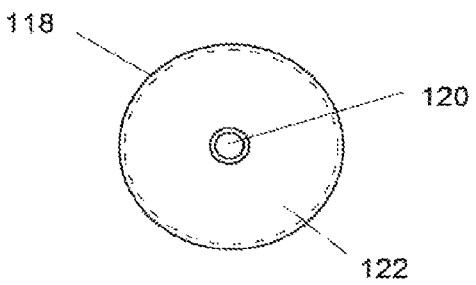
FIG. 15A shows a plan view of an insert for paper clip-light combination, according to the present invention.
Figure 16:
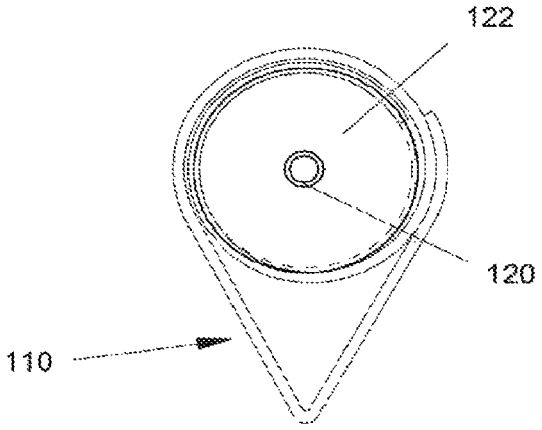
FIG. 16 shows a plan view of a paper clip-light combination, using the insert of FIGS. 15A and 15B, according to the present invention.
Figure 15B:
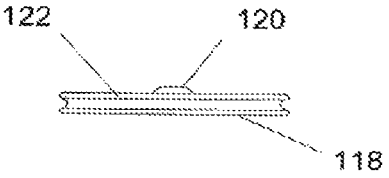
FIG. 15B shows an elevation side view of the insert of FIG. 13A.

Referring to FIGS. 15A, 15B and 16, in another preferred embodiment of a paper clip 110, an insert plate 118 is equipped with an activatable signal light assembly, that includes a light emitting diode (LED) 120, an oscillating circuit (not shown), an on/off switch (surface 122 of plate 118) and a battery, thereby permitting a user to draw attention to an important sheaf of papers by clipping clip 110 to the sheaf of papers and turning on the switch, thereby activating flashing LED 120.

Figure 17:
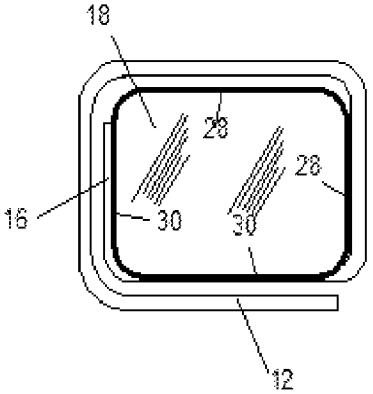
FIG. 17 shows a plan view of another alternative embodiment of a paper clip, according to the present invention.

Referring to FIG. 17, in an additional alternative preferred embodiment, the inner loop 16 is abbreviated, as is outer loop 14, thereby reducing wire costs. The structural integrity lent by the plate, permits functionality with less wire. To hold a thick sheaf of papers, inner loop 16 slightly disengages from plate, in wire length 28, but to prevent inner loop 16 from completely disengaging, wire length 30 is affixed to plate 18, for example by being adhered or soldered to plate 18.

Figure 18:
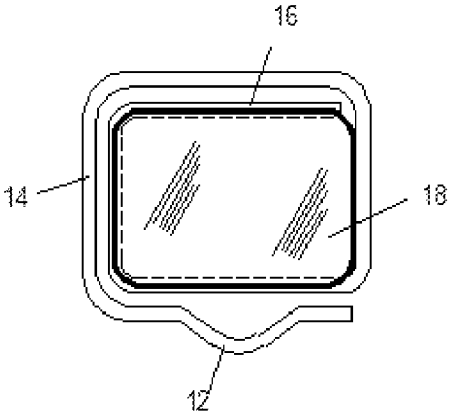
FIG. 18 shows a plan view of another alternative embodiment of a paper clip, according to the present invention.

Referring to FIG. 18 in additional alternative embodiment, additional wire is added to outer jaw 12, to provide a more substantial outer jaw 12, which presses against the paper being held over a larger area.

Figure 19:
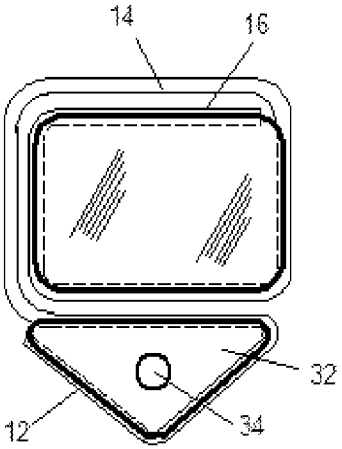
FIG. 19 shows a plan view of another alternative embodiment of a paper clip, according to the present invention.

Referring to FIG. 19, in an additional alternative embodiment a second wire loop is added, which holds a second plate 32, which has embedded within it a magnet 34. The clip is held to a metal surface by magnet 34, and papers may be held in place between inner loop 16 and outer loop 14.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A paper clip assembly, comprising:

(a) a wire frame, formed into:

i) a first loop;

ii) a second loop; and iii) a jaw protruding outwardly from said first loop such that said jaw partially encircles said first loop and bends away from said first loop, wherein said jaw connects to said second loop such that said second loop is not overlapping said first loop and said jaw partially encircles said second loop, further wherein said first loop and said second loop comprise separate loops, and each of said first loop and said second loop is substantially closed;

(b) a first plate insert shaped to fit said first loop, wherein said first plate insert is secured to said first loop; and (c) a second plate insert shaped to fit said second loop, wherein said second plate insert is secured to said second loop.

2. The paper clip assembly of claim 1, wherein said first plate insert hosts a sound chip, said sound chip bearing a sound recording.

3. The paper clip assembly of claim 1, wherein each of said first plate insert and said second plate insert bears an image.

4. The paper clip assembly of claim 3, wherein said image includes writing.

5. The paper clip assembly of claim 1, wherein said first loop and said second loop are different in shape and size.

6. The paper clip assembly of claim 1, wherein each of said first plate insert and said second plate insert defines edges that are indented in a shape that matches the cross-sectional shape of said wire frame.

7. The paper clip assembly of claim 1, wherein said first plate insert includes a light source and a switch for activating said light source.

8. The paper clip assembly of claim 7, wherein said first plate insert further includes an electrical network for causing said light source to flash when said switch is activated.

9. The paper clip assembly of claim 1, wherein said wire frame is, in places, firmly affixed to said first plate insert and said second plate insert, to prevent said first plate insert and said second plate insert from slipping out of said wire frame while being deployed.

10. The paper clip assembly of claim 9, wherein said wire frame is firmly affixed to said first plate insert and said second plate insert, by being adhered to said first plate insert and said second plate insert.

11. The paper clip assembly of claim 1, wherein said first loop and said second loop are separated by a space.

12. The paper clip assembly of claim 1, wherein said second plate insert comprises a magnet.

13. The paper clip assembly of claim 1, wherein said first loop and said second loop are substantially coplanar and said first plate insert and said second plate insert are substantially coplanar.

14. A method of drawing attention to a set of papers, comprising:

(a) providing a paper clip having a wire frame, said wire frame comprising a first loop and a jaw that protrudes outwardly from said first loop and bends away from said first loop to connect to a second loop such that said first loop does not overlap said second loop and said first loop and said second loop are separate loops, said first loop holding a first plate insert and said second loop holding a second plate insert, said first plate insert bearing an activatable signal light assembly;

(b) clipping said paper clip to said set of papers;

(c) activating said signal light assembly; and (d) whereby said set of papers has a signal light attached to it, attracting attention to it.

15. The method of drawing attention to a set of papers of claim 14, wherein said activatable signal light assembly includes a light emitting diode.

16. The method of drawing attention to a set of papers of claim 14, wherein said activatable signal light assembly causes said signal light to blink on and off, so as to better draw attention to itself.

17. A method of providing paper clips bearing a message, comprising:

(a) providing a wire frame, said wire frame defining a first opening that is partially encircled by a jaw that bends away from said first opening and connects to a second opening, wherein said first opening and said second opening do not overlap one another and said first opening and said second opening are separate openings;

(b) providing a first plate insert, said first plate insert sized and shaped to be retained in said first opening;

(c) providing a second plate insert, said second plate insert sized and shaped to be retained in said second opening;

(d) providing a set of adhesive labels, sized and shaped to be adhered to said first plate insert and said second plate insert;

(e) printing a message on each of said labels;

(f) adhering each of said labels to said first plate insert and said second plate insert; and (g) placing said first plate insert into said first opening and said second plate insert into said second opening.

18. The method of providing paper clips bearing a message of claim 17, wherein step (g) is performed before step (f).

* * * * *